US006762724B2

(12) United States Patent
Peng

(10) Patent No.: US 6,762,724 B2
(45) Date of Patent: Jul. 13, 2004

(54) BUILD-IN ANTENNA FOR A MOBILE COMMUNICATION TERMINAL

(75) Inventor: Hongli Peng, Shenzhen (CN)

(73) Assignee: ZTE Corporation, Guangdong (CH)

( * ) Notice: Subject to any disclaimer, the term of this patent is extended or adjusted under 35 U.S.C. 154(b) by 0 days.

(21) Appl. No.: 10/333,992

(22) PCT Filed: Dec. 7, 2001

(86) PCT No.: PCT/CN01/01610

§ 371 (c)(1),
(2), (4) Date: Jan. 27, 2003

(87) PCT Pub. No.: WO02/054530

PCT Pub. Date: Jul. 11, 2002

(65) Prior Publication Data

US 2003/0137461 A1 Jul. 24, 2003

(30) Foreign Application Priority Data

Dec. 30, 2000 (CN) ..... 00268507 U

(51) Int. Cl.[7] ..... H01Q 1/24

(52) U.S. Cl. ..... 343/702; 343/700 MS; 343/834; 343/873

(58) Field of Search ..... 343/700 MS, 702, 343/815, 817, 818, 829, 833, 834, 846, 873

(56) References Cited

U.S. PATENT DOCUMENTS 5,966,097 A 10/1999 Fukasawa et al.
6,147,659 A 11/2000 Takahashi et al.
6,288,682 B1 * 9/2001 Thiel et al. ..... 343/702
6,320,545 B1 * 11/2001 Nagumo et al. ..... 343/700 MS
6,362,784 B1 3/2002 Kane et al.
6,509,882 B2 * 1/2003 McKivergan ..... 343/818
6,570,538 B2 * 5/2003 Vaisanen et al. ..... 343/702
6,608,594 B1 * 8/2003 Kane et al. ..... 343/700 MS
6,614,400 B2 * 9/2003 Egorov ..... 343/702
6,639,564 B2 * 10/2003 Johnson ..... 343/702

FOREIGN PATENT DOCUMENTS

JP 11-346114 12/2000

* cited by examiner

*Primary Examiner*—Tho Phan
(74) *Attorney, Agent, or Firm*—Finnegari, Henderson, Farabow, Garrett & Dunner, L.L.P.

(57) ABSTRACT

An embedded antenna for a mobile terminal, comprising a conductor unit (101), including a PCB, and having a metal-layer-stripped region on its top; an antenna unit (102), including a PCB, being vertically connected to the metal-layer-stripped region on top of said conductor unit, and having a ground pin (204) and a feed pin (205) to be connected to circuits within said mobile terminal; a parasitic unit (103), with one end being attached to said antenna unit, and another end being apart from and in parallel to said antenna unit. The antenna has very small size, is efficiently operative on the frequency bands of GSM900 and DCS1800, and has a moderate gain and a lower SAR.

15 Claims, 9 Drawing Sheets

BUILD-IN ANTENNA FOR A MOBILE COMMUNICATION TERMINAL

TECHNICAL FIELD

The present invention relates to an embedded antenna for a mobile terminal, particularly to an embedded antenna for a terminal of a GSM/DCS dual frequency mobile communication system.

BACKGROUND ART

Along with the rapid development and widespread application of mobile communication technology, mobile telephones tend to be much more compact, to support multi-mode (to be compatible to GSM900/DCS1800, PCS, IS-95 and future 3G systems), and to be of higher performance.

For manufacturers of the mobile terminals, the radio frequency (RF) part, the base band part and the digital signal processing (DSP) part of a mobile terminal have so far been implemented at a high level integration, which strongly facilitate the reduction of size and cost of mobile terminals. However, the antenna part as well as its' feed part of a mobile terminal, have progressed slowly for their performance and size having been limited by the terminal structure, fixed positions of electronic component, and characteristics of material of the terminal housing. Thus the integration level of the antenna of the mobile terminal is still relatively low and the cost is still relatively high, thereby restricting the further development of the mobile terminal. Due to the combination of the mobile communication and computer networks the problem will be more serious in the future mobile terminal supporting multi-mode.

On the other hand, as people increasingly realize that the mobile terminal's electromagnetic radiation may impose the damage on a human body, users are intensively demanding a mobile terminal with a low electromagnetic radiation without degrading its existing performance. With respect to external antenna technologies widely used in the mobile terminals, it is typical to adopt an antenna or its combination that is symmetric in structure and radiating directions. Consequently, it is impossible to meet the above-mentioned requirements of the users.

Embedded antennas have been developed under this circumstance. Using the embedded antennas, a mobile terminal may have a more flexibility in shape design and smaller size, a lower signal absorption ratio (SAR), and a higher peak gain, and among other things, an embedded antenna can be used to implement an antenna array with a relatively small size. It can be envisioned that the embedded antenna represents a future development direction of mobile terminal antennas.

However, all the existing planar embedded antennas have been designed within a two-dimensional plane. Since such designs have only two dimensions for extension, there are some disadvantages as follows:

1. the antenna is too large to be applicable to the minimized mobile terminals (such as pocket handsets) whose sizes are greatly restricted;
2. the embedded antenna needs a support or be attached to a housing for its installation, thereby causing increasing of production cost and degrading of reliability and maintainability;
3. the electrical characteristics are relatively poor, for example, the in-band Voltage Standing Wave Ratio (VSWR) is too high, which reduces the efficiency of the antenna and increase the power reflection of the handset.

SUMMARY OF THE INVENTION

In order to overcome the disadvantages of the prior art as described above, it is an object of the invention to provide an embedded antenna for a mobile terminal with a three-dimensional structure.

In one aspect of the invention, there provides an embedded antenna for a mobile terminal, comprising a conductor unit, including a print-circuit-board (PCB), and having a metal-layer-stripped region formed on the top of the conductor unit; an antenna unit, including another PCB, being vertically connected to the metal-layer-stripped region on top of the conductor unit, and having a ground pin and a feed pin to be connected to circuits within the mobile terminal; a parasitic unit, with one side being attached to the antenna unit, and another side being apart from and in parallel to the antenna unit.

Further more, the antenna unit may be substantially rectangular, and have a first long edge connected to the conductor unit, a second long edge opposite to the first one and being apart from the conductor unit, and a first and a second short edge opposite to each other; wherein the antenna unit has a C-shaped etched region in the middle of a second surface, where the opening of the C shape is directed to the second short edge, the etched region begins from the middle of second long edge of the antenna unit, extends towards the first long edge and then towards the first short edge, extends once again towards the first long edge and then towards the second short edge, and finally protrudes towards the second long edge at its rear end.

According to another aspect of the invention, there provides a mobile terminal having an antenna as described above, wherein said mobile terminal comprises a grounding board to be used as a conductor unit.

DESCRIPTION OF PREFERRED EMBODIMENTS

The invention will be described in detail according to the embodiments of the invention in connection with the accompany drawings.

Figure 1:
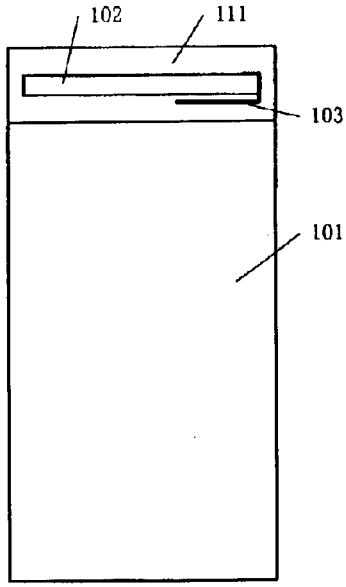
FIG. 1 is a front view of an embedded antenna for a mobile terminal in the mobile communication system according to an embodiment of the invention.
Figure 2:
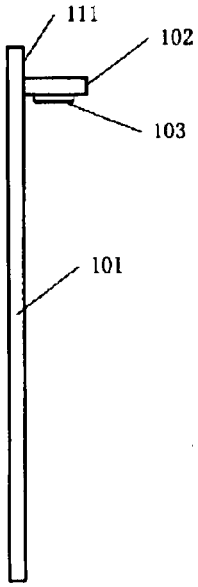
FIG. 2 is a left side view of the embedded antenna as shown in FIG. 1.

FIG. 1 is a front view of an embedded antenna for a mobile terminal in the mobile communication system according to an embodiment of the invention. FIG. 2 is a left side view of the embedded antenna as shown in FIG. 1. As shown in FIGS. 1 and 2, the embedded antenna according to the invention is composed of three parts: a conductor unit 101, an antenna unit 102 and a parasitic unit 103 of the antenna.

The conductor unit 101 is a rectangular PCB with a metal-layer-stripped region 111 on its top. The antenna unit 102 is a PCB vertically connected to the metal-layer-stripped region 111 on top of the conductor unit 101. The parasitic unit 103 is a sheet of conductive material having certain strength, such as a metal sheet. The parasitic unit 103 is fixed on the right side of the antenna unit 102 and connected to the upper surface of the antenna unit 102. The parasitic unit 103 extends from the right edge of the antenna unit 102 and then is bended at right-angle in twice, and finally extends in parallel to and without contacting the bottom surface of the antenna unit 102.

The conductor unit 101 may be a grounding board of the mobile terminal rather than a separate PCB, so that the size of the mobile terminal can be reduced greatly. The antenna unit 102 is a PCB with copper coated on its both sides, and has three conductive strips printed on its upper surface.

Figure 3:
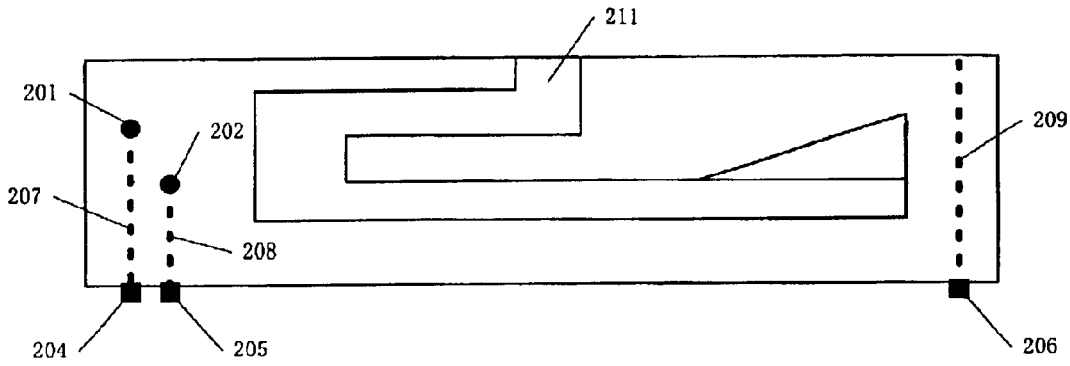
FIG. 3 is an bottom view of an antenna unit of an embedded antenna of a mobile terminal in the mobile communication system according to an embodiment of the invention.

FIG. 3 is an bottom view of an antenna unit 102 of an embedded antenna of a mobile terminal in the mobile communication system according to an embodiment of the invention. On a long side of the antenna unit 102 closing to the conductor unit 101, there are three pins, namely a ground pin 204, a feed pin 205 and a support pin 206. The ground pin 204 is connected to the ground of the mobile terminal; the feed pin 205 is connected to the internal circuit of the mobile terminal for receiving and transmitting signals. These three pins are connected respectively to the three conductive strips 207, 208 and 209 (as indicated by the broken lines in FIG. 3) on the upper surface. As shown in FIG. 3, the conductive strip 207 connected to the ground pin 204 is connected to the grounding point 201 on the bottom surface of the antenna unit 102, via a metalized grounding hole penetrating both sides of the antenna unit 102; the conductive strip 208 connected to the feed pin 205 is connected to the feeding point 202 on the bottom surface of the antenna unit 102, via a metalized feeding hole penetrating both sides of the antenna unit 102.

As shown in FIG. 3, there is a C-shaped etched region 211 in the middle of the bottom surface of the antenna unit 102. The etched region 211 begins from the middle of a long edge of the antenna unit 102, which is opposite to the conductor unit 101. The etched region 211 extends firstly downwards and then towards left, extends downwards again and then towards right, and finally protrudes at its rear end towards the long edge opposite to the conductor unit 101.

Figure 4:
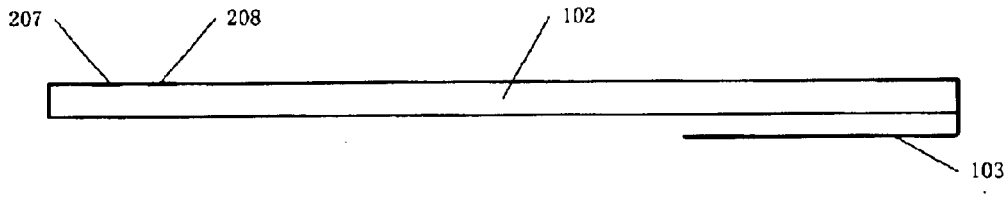
FIG. 4 is a front view of an antenna unit and a parasitic unit of an embedded antenna according to the embodiment of the invention.

FIG. 4 is a front view of an antenna unit and a parasitic unit of an embedded antenna according to the embodiment of the invention. As shown in FIG. 4, the parasitic unit 103 contacts with the upper surface of the antenna unit 102, goes along the right edge of the antenna unit 102 with two right-angle bends, and then extends in a way that is apart from and in parallel to the bottom surface of the antenna unit 102.

The principle of the embedded antenna according to the invention will now be described. Three parts of the embedded antenna, namely the conductor unit 101, the antenna unit 102 and the parasitic unit 103, work together to perform a conversion between the electromagnetic wave and the high-frequency current.

The conductor unit 101 is designed to form, together with the antenna unit 102 and the parasitic unit 103, an open structure for converting the electromagnetic wave and the high-frequency current, and to facilitate the directionality of the electromagnetic wave's emission/reception of the antenna unit 102 and the parasitic unit 103.

The etched pattern on the bottom surface of the antenna unit 102 forms two electromagnetic resonator connected in parallel, for selecting the frequency of a carrier signal. These resonators are designed to meet the bandwidth requirements of GSM900 and DCS1800, and have low loss. The join point of two resonators is located at the feeding point 202, a common feeding point shared by them.

Figure 5:
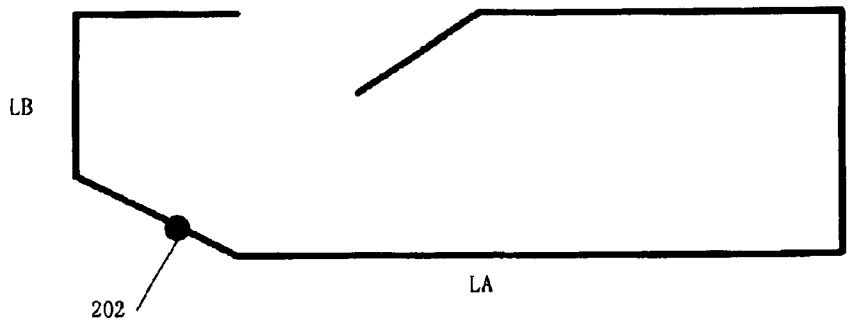
FIG. 5 is a principle diagram of an antenna unit.

FIG. 5 is a principle diagram of an antenna unit. As shown in FIG. 5, there are two open circuits of different lengths on both sides of the feeding point 202. Between the two segments of the conductive strip divided by the feeding point 202, it assumes that the longer segment LA is of length La, and the short segment LB is of length Lb. For the two resonators being operative on the frequency bands of GSM900 and DCS1800 respectively, their geometric shapes should meet the following requirement: the lengths of their geometric shapes should meet the resonator criterion, i.e. ¼ waveguide wavelength criterion. Therefore, La and Lb should meet:

$$La = \frac{\lambda_1}{4\sqrt{\varepsilon_{re1}}} \tag{1}$$

$$Lb = \frac{\lambda_2}{4\sqrt{\varepsilon_{re2}}} \tag{2}$$

where La, $\lambda_1$,$\epsilon_{re1}$ are respectively the length of the segment LA, the working wave length of GSM900, and the effective dielectric capacity of the dielectric below the segment LA; Lb, $\lambda_2$, $\epsilon_{re2}$ are respectively the length of the segment LB, the working wave length of DCS1800, and the effective dielectric capacity of the dielectric below the segment LB. As described above, two electromagnetic resonant loops are formed on the antenna unit 102, i.e. LA and LB, respectively syntonizing on two working frequency bands (GSM900/DCS1800). However, the high-frequency current occurring on the low-frequency end (GSM900 frequency band) presents a higher reactance at the feeding point of the antenna unit 102. Accordingly, the antenna's standing wave ratio is high on the GSM900 frequency band as a result the radiation efficiency of the embedded antenna is low on this frequency band. The invention solves this problem by using the parasitic unit 103 of the embedded antenna.

The invention will be further described in connection with an embodiment.

Figure 6:
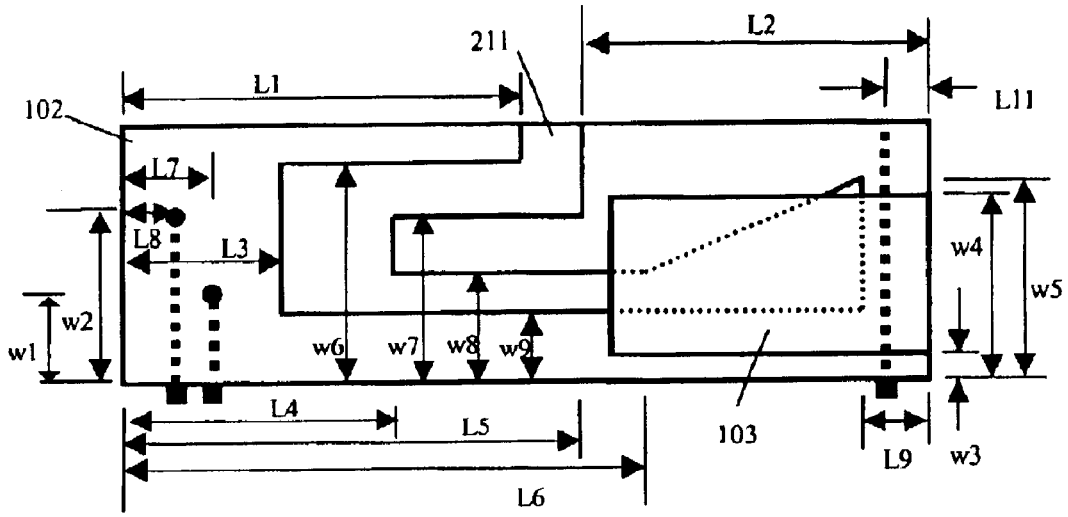
FIG. 6 is an bottom view of an antenna unit and a parasitic unit of an embedded antenna according to the embodiment of the invention.

FIG. 6 is an bottom view of an antenna unit and a parasitic unit of an embedded antenna according to the embodiment of the invention. According to the embodiment, as shown in FIG. 6, in the etched pattern on the bottom surface of the antenna unit 102, on the long side opposite to the conductor unit 101, the distance between the left edge of the opening of the etched region 211 and the left edge of the antenna unit 102 is L1=20.0 mm; the distance between the right edge of the opening of the etched region 211 and the right edge of the antenna unit 102 is L2=14.0 mm; the distance between the most left edge of the etched region 211 and the left edge of the antenna unit 102 is L3=5.5 mm; the distance between the edge of the etched region 211 most recessed towards the left edge of the antenna unit and the left edge of the antenna unit is L4=6.5 mm; on the long side opposite to the conductor unit 101, the distance between the right edge of the opening of the etched region 211 and the left edge of the antenna unit 102 is L5=21.0 mm; the distance between the root of the protuberance at the rear end of the etched region 211 and the left edge of the antenna unit 102 is L6=22.2 mm; the distance between the feeding point 202 and the left edge of the antenna unit 102 is L7=3.8 mm; the distance between the grounding point 201 and the left edge of the antenna unit 102 is L8=1.5 mm; the distance between the most right edge of the etched region 211 and the right edge of the antenna unit 102 is L9=6.5 mm; the distance from the support pin 206 and the corresponding conductive strip 209 to the right edge of the antenna unit 102 is L11=2.0 mm.

As shown in FIG. 6, the distance between the feeding point 202 and the long edge on the side of the antenna unit 102 towards the conductor unit 101 is w1=2.1 mm; the distance between the grounding point 201 and the long edge on the side of the antenna unit 102 towards the conductor unit 101 is w2=5.9 mm; the distance between the edge on the side of the parasitic unit 103 towards the conductor unit 101 and the long edge on the side of the antenna unit 102 towards the conductor unit 101 is w3=0 mm; the distance between the edge on the side of the parasitic unit 103 opposite to the conductor unit 101 and the long edge on the side of the antenna unit 102 towards the conductor unit 101 is w4=6.0 mm; the distance between the top of the protuberance of the rear end of the etched region 211 and the long edge on the side of the antenna unit 102 towards the conductor unit 101 is w5=5.5 mm; the distance between the outer edge of the etched region 211 most apart from the conductor unit 101 and the long edge on the side of the antenna unit 102 towards the conductor unit 101 is w6=5.0 mm; the distance between the inner edge of the etched region 211 most apart from the conductor unit 101 and the long edge on the side of the antenna unit. 102 towards the conductor unit 101 is w7=4.7 mm; the distance between the inner edge of the etched region 211 closest to the conductor unit 101 and the long edge on the side of the antenna unit 102 towards the conductor unit 101 is w8=2.6 mm; the distance between the outer edge of the etched region 211 closest to the conductor unit 101 and the long edge on the side of the antenna unit 102 towards the conductor unit 101 is w9=2.2 mm.

Figure 7:
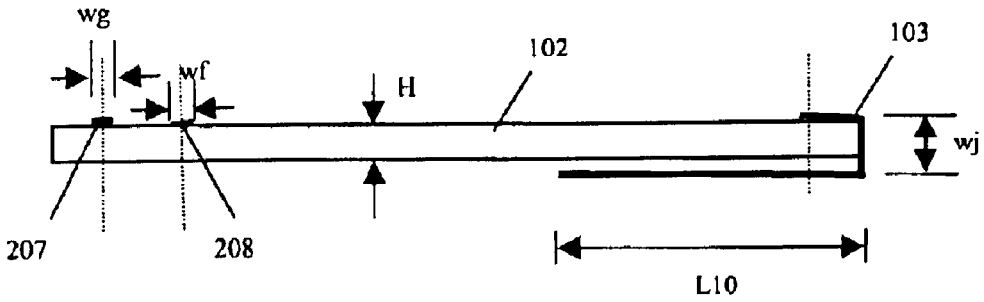
FIG. 7 is a front view of the antenna unit and the parasitic unit as shown in FIG. 6.

FIG. 7 is a front view of the antenna unit and the parasitic unit as shown in FIG. 6. As shown in FIG. 7, the thickness of the antenna unit 102 is H=1.0 mm; the width of the conductive strip 208 connected to the feeding point 202 is wf=1.5 mm; the width of the conductive strip 207 connected to the grounding point 201 is wg=1.5 mm; the distance between the left edge of the parasitic unit 103 under the bottom surface of the antenna unit 102 and the right edge of the antenna unit 102 is L10=14.5 mm; the distance between the edge of the parasitic unit 103 in parallel to and apart from the antenna unit 102 and the opposite surface of the antenna unit 102 is wj=3.0 mm.

Figure 8:
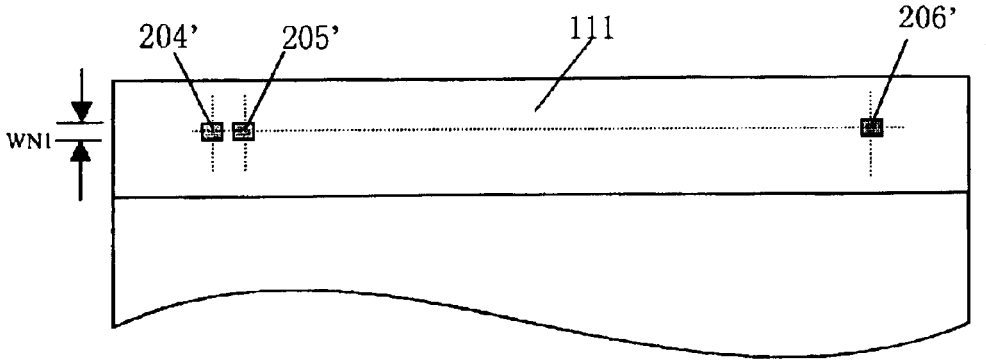
FIG. 8 shows a part of a conductor unit of an embedded antenna according to an embodiment of the invention, for illustrating the connection relationship between the conductor unit and the antenna unit.

FIG. 8 shows a part of a conductor unit 101 of an embedded antenna according to an embodiment of the invention. As shown in FIG. 8, the three blind holes 204', 205' and 206' are arranged to be respectively connected to the ground pin 204, feed pin 205 and support pin 206 of the antenna unit 102, and each has a width of WN1=1.0 mm.

Figure 9:
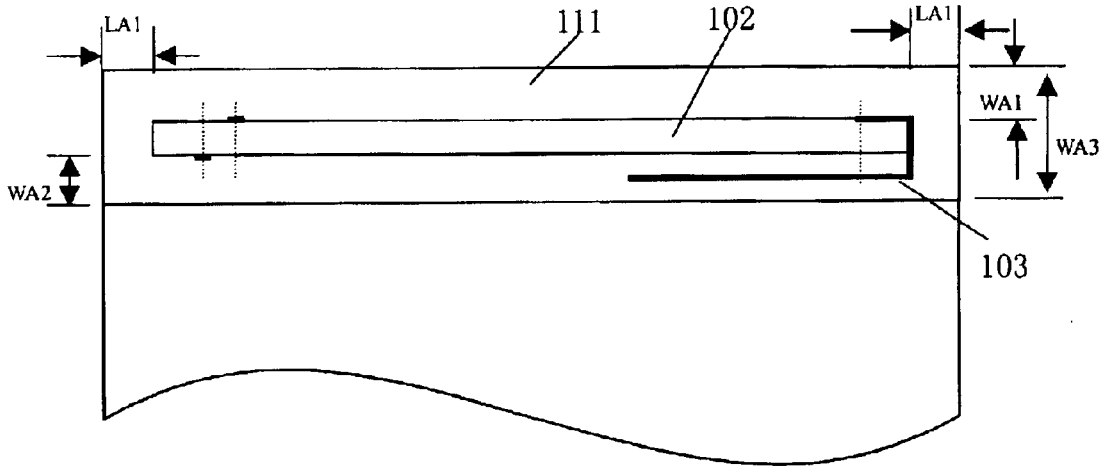
FIG. 9 shows a part of an antenna unit and a conductor unit of an embedded antenna according to the embodiment of the invention, for illustrating the connection relationship between the conductor unit and the antenna unit.
Figure 10:
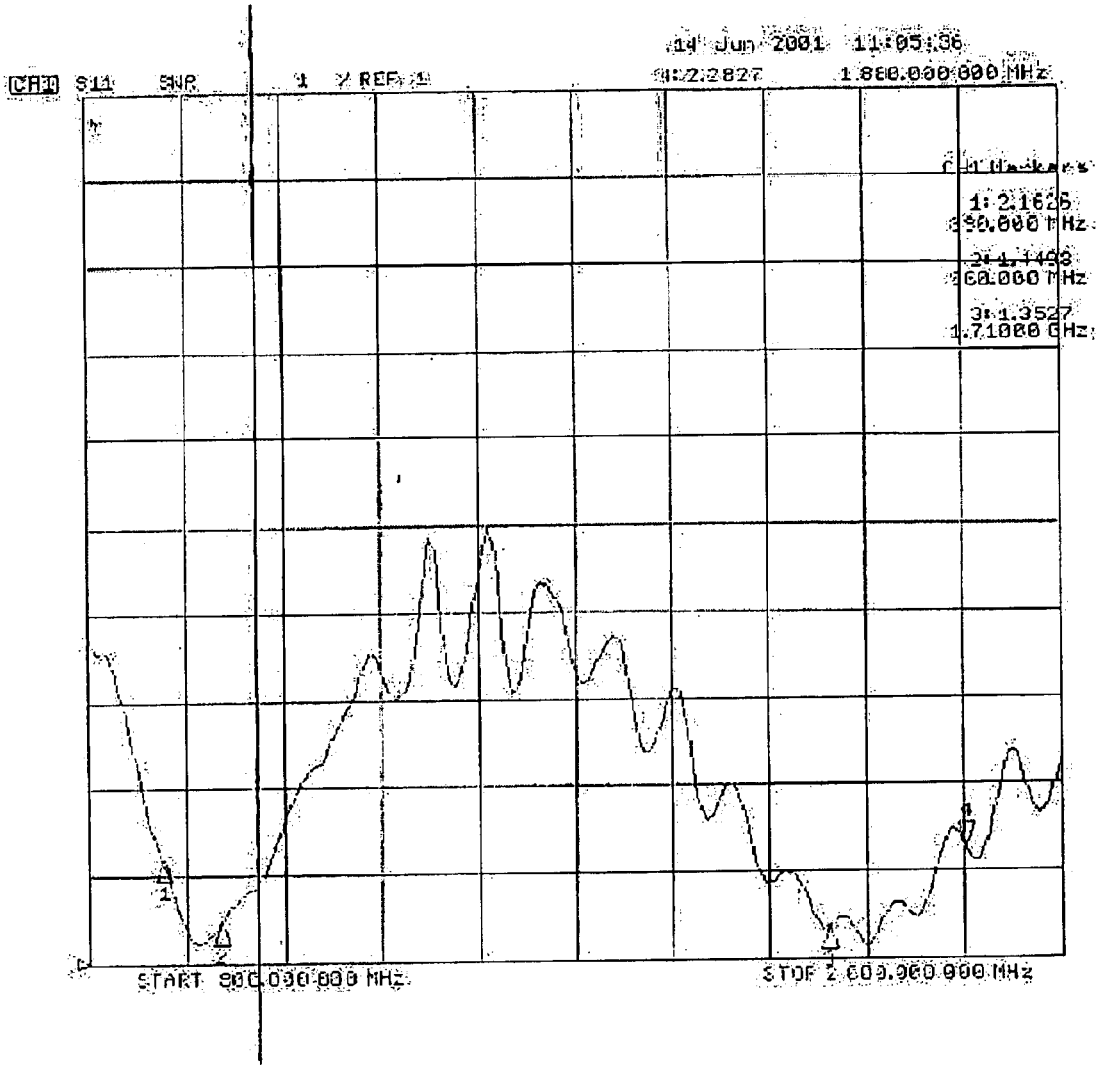
FIG. 10 is a graph of Voltage Standing Wave Ratio (VSWR) while testing an embedded antenna of a mobile terminal in the mobile communication system according to an embodiment of the invention.
Figure 11:
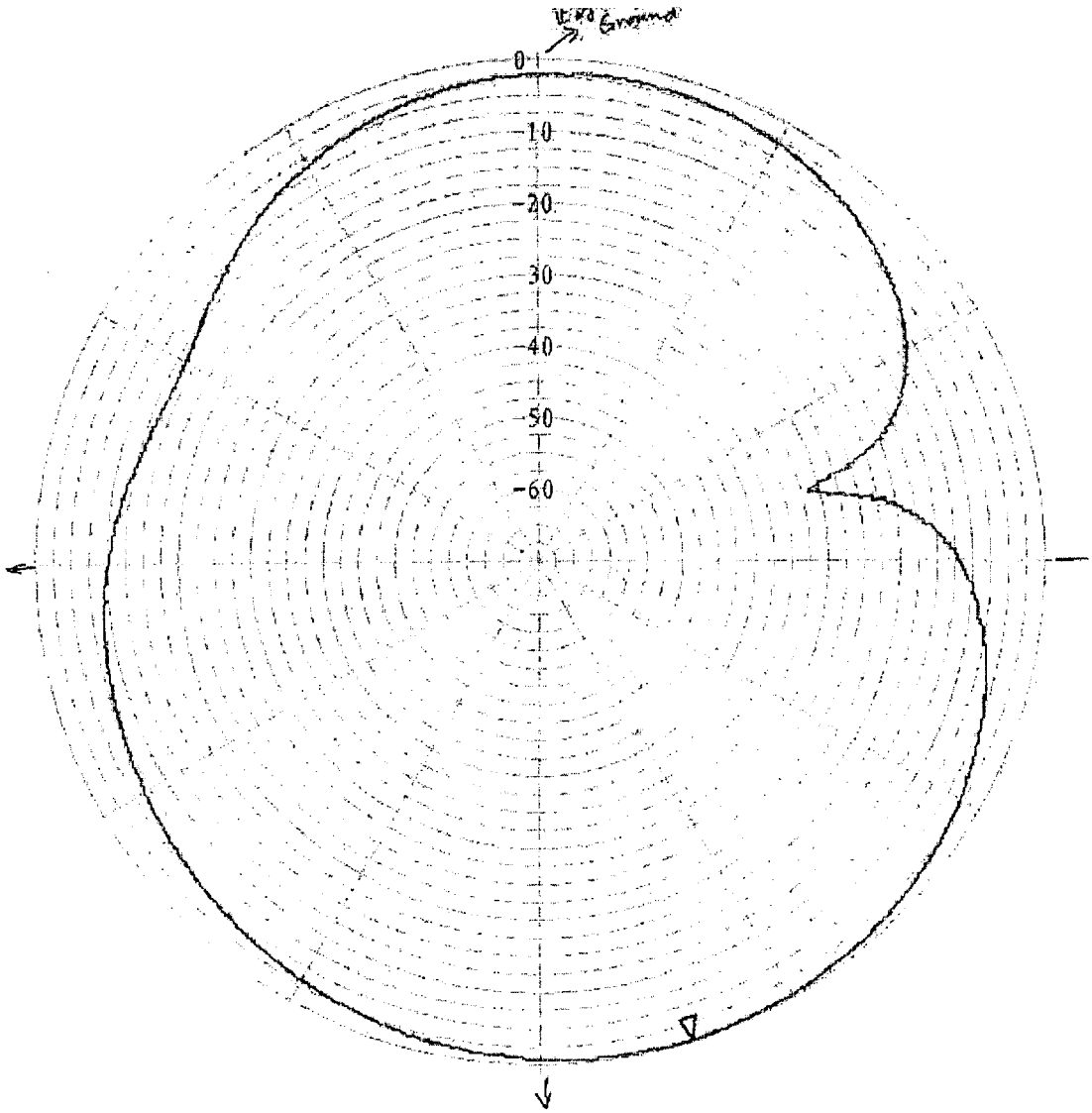
FIG. 11 is a graph of an E-plane antenna pattern of 900 MHz while testing an embedded antenna of a mobile terminal in the mobile communication system according to an embodiment of the invention.
Figure 12:
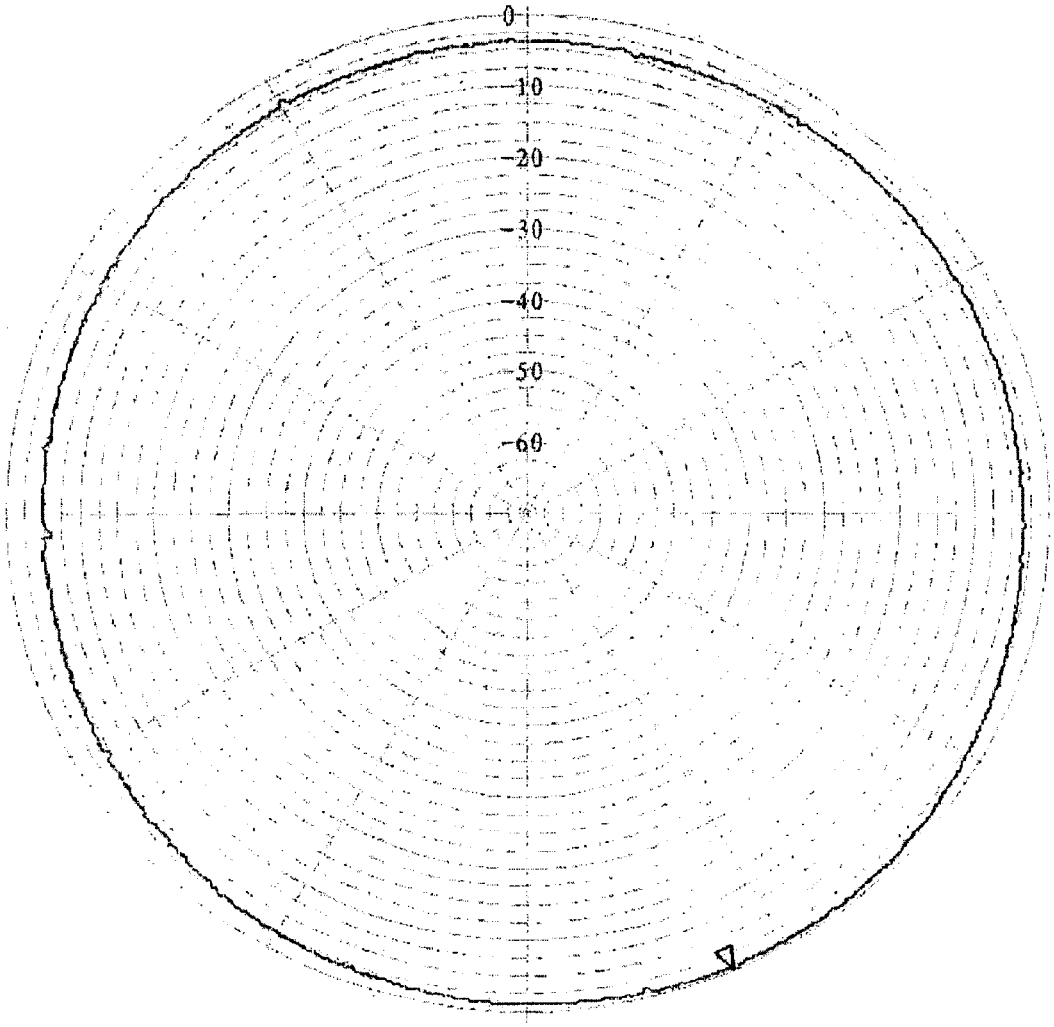
FIG. 12 is a graph of an H-plane antenna pattern of 900 MHz while testing an embedded antenna of a mobile terminal in the mobile communication system according to an embodiment of the invention.
Figure 13:
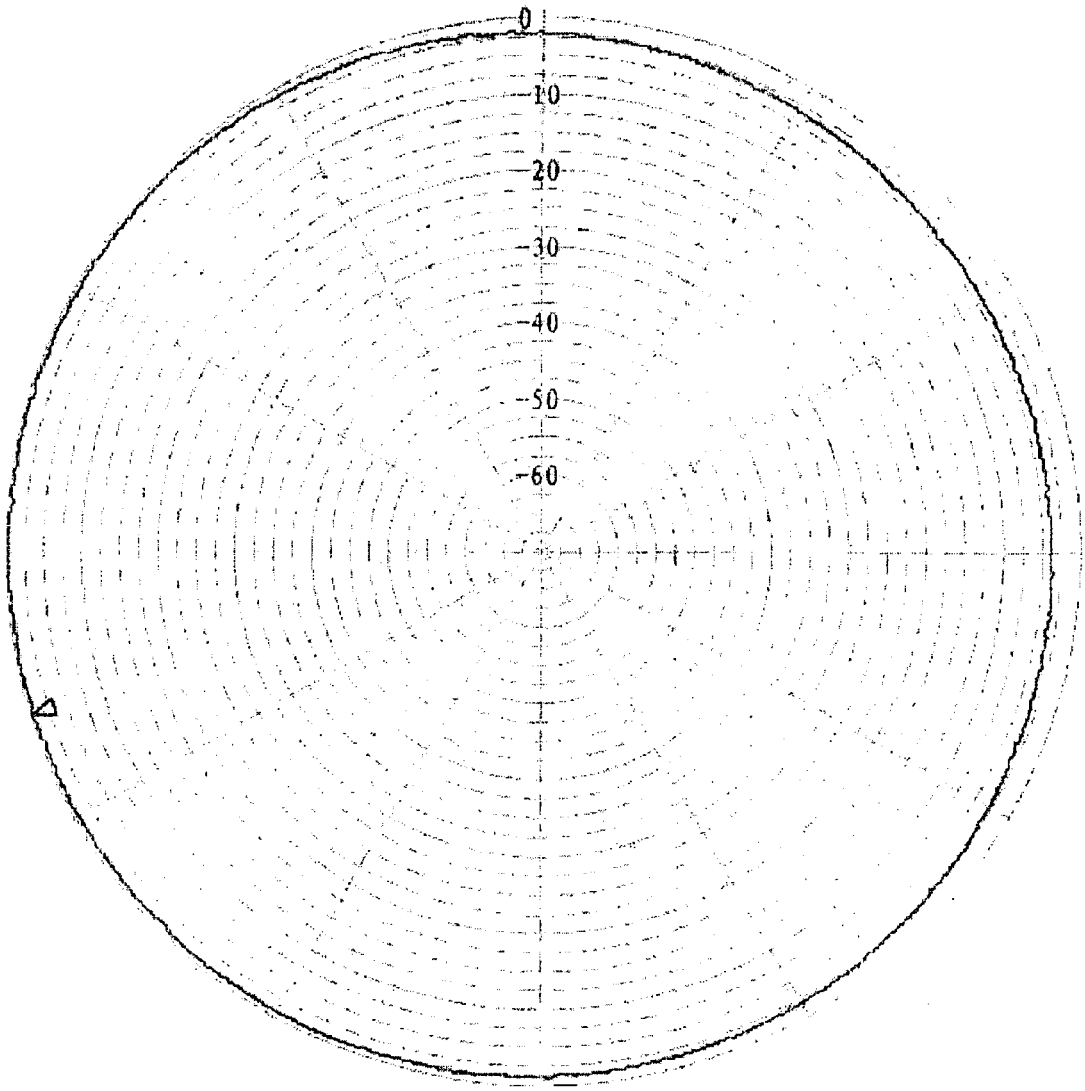
FIG. 13 is graph of an E-plane antenna pattern of 1800 MHz while testing an embedded antenna of a mobile terminal in the mobile communication system according to an embodiment of the invention.
Figure 14:
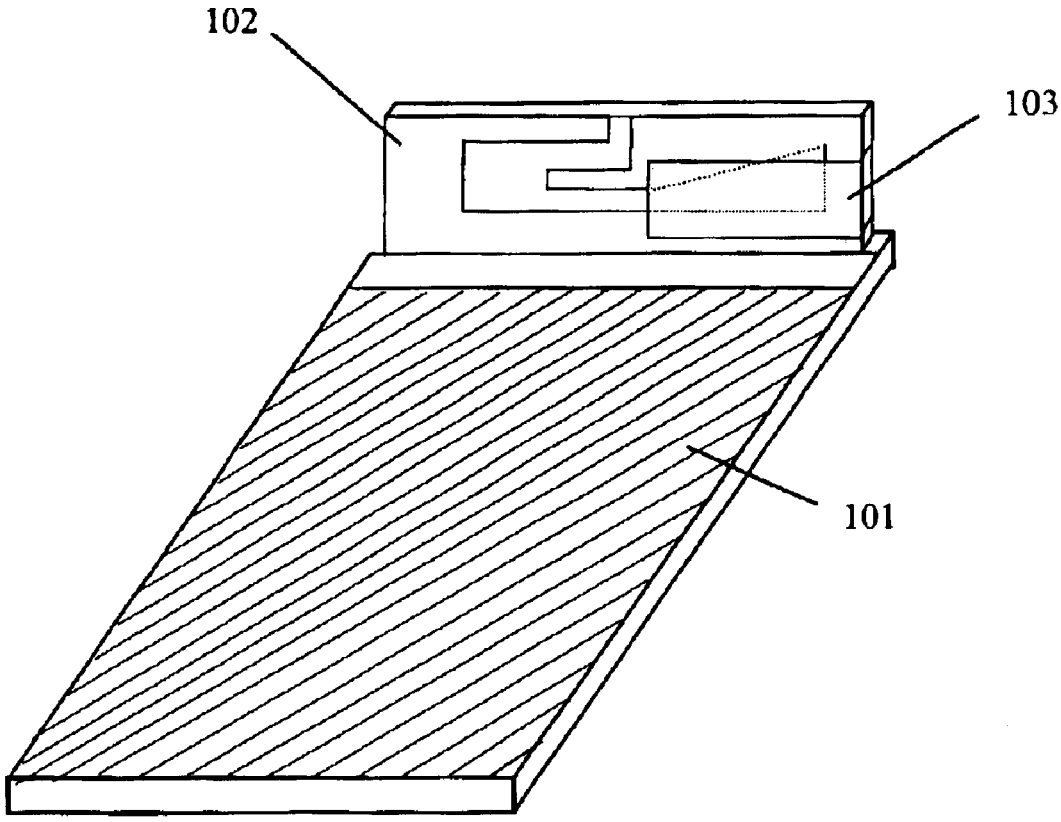
FIG. 14 is a perspective view of an embedded antenna for a mobile terminal in the mobile communication system according to an embodiment of the invention.

FIG. 9 shows a part of an antenna unit and a conductor unit of an embedded antenna according to the embodiment of the invention. As shown in FIG. 9, the distance between the edges on the both sides of the antenna unit 102 and the edges on the both sides of the conductor unit 101 is LA1=2.0 mm; the distance between the bottom surface of the antenna unit 102 and the bottom edge of the stripped region 111 on top of the conductor unit 101 is WA2=4.0 mm; the distance between the upper surface of the antenna unit 102 and the upper edge of conductor unit 101 is WA1=2.0 mm; the distance between the upper edge of the conductor unit 101 and the bottom edge of the stripped region 111 on top of the conductor unit 101 is WA3=7.0 mm. According to the embodiment of the invention, above values may have certain tolerances specifically as below:

L1=20.0±0.1 mm, L3=5.5±0.1 mm, L4=6.5±0.02 mm, L5+L2=21.0±0.1 mm, L6=22.2±0.1 mm, L7=3.8±0.02 mm, L8=1.5±0.02 mm, L9=6.5±0.02 mm, L10=14.5±0.02 mm, L11=2.0±0.02 mm, w1=2.1±0.02 mm, w2=5.9±0.02 mm, w3=±0.1 mm, w4=6.0±0.1 mm, w5=5.5±0.1 mm, w6=5.0±0.1 mm, w7=4.7±0.1 mm, w8=2.6±0.1 mm, w9=2.2±0.1 mm, H=1.0 mm, wf=1.5±0.1 mm, wj=3.0±0.1 mm, wg=1.5±0.1 mm, others ±0.1 mm.

The embedded antenna according to above embodiments of the invention is fixed into a ABS plastic housing of 98 mm *40 mm *16 mm, which is place on a three-dimensional test frame. The test frame and the antenna are together placed in a microwave dark-room. VSWR of the antenna is measured by means of a HP8753E vector network analyzer. Measurement on the direction pattern and gain is performed by means of an antenna analyzer and by comparison method.

FIGS. 10–13 shows the testing results of electrical performance parameters for an embedded antenna of a mobile terminal in the mobile communication system according to an embodiment of the invention. It can be seen, from FIG. 10, that the embedded antenna according to the embodiment of the invention is efficiently operative on the frequency bands of GSM900/DCS1800. It can be seen, from FIGS. 11–13, that the direction pattern of the invention's embedded antenna is characterized in that, on the H-plane, there is an energy depression of 30 dB in the direction at an angle of 75 degrees relative to the outer normal direction, which is towards the head of a human; similarly on the E-plane, there is an energy depression of 4 dB in the direction towards the head of a human. The graphs show that the embedded antenna of the invention has lower SAR characteristics, that is, provides a certain protection to the human body. By further measurement, it can be seen that the embedded antenna has a moderate gain (greater than 0.5 dBi).

Further more, according to other embodiments of the invention, the patterns of upper surface and bottom surface of the antenna unit 102 may be changed in a mirror-image manner, the upper surface and bottom surface of the antenna unit 102 may be interchanged with each other, and the corresponding parasitic unit 103 may be placed above, apart from and in parallel to the upper surface of the antenna unit 102. According to another embodiment of the invention, a mobile phone is equipped with an embedded antenna as described above, its grounding main board is used as the conductor unit 101 of the embedded antenna, and the feed pin 205 of the antenna unit 102 is electrically connected to the duplexer of the RF portion of the circuit in the mobile phone. While the invention has been described above in connection with the specific embodiments of the invention, it should be understood that, the invention is not limited to these embodiments, and can have various changes and modifications. For example, the etched pattern of the antenna unit 102 may have other variants, which can also meet the requirements for forming a resonator circuit, and may have other changes in specific shapes and distances. All these changes and modifications should be within the scope as defined by the appended claims without departing from the spirit of the invention.

What is claimed is:

1. An embedded antenna for a mobile terminal, comprising a conductor unit (101) including a PCB and having a metal-layer-stripped region (111) on its top;

an antenna unit (102) including a PCB, being vertically connected to the metal-layer-stripped region on top of said conductor unit, and having a ground pin (204) and a feed pin (205) to be connected to circuits within said mobile terminal;

a parasitic unit (103), with one end being attached to said antenna unit and another end being apart from and in parallel to said antenna unit.

2. An embedded antenna for a mobile terminal according to claim 1, wherein said antenna unit is a grounding board of said mobile terminal.

3. An embedded antenna for a mobile terminal according to claim 1, wherein said antenna unit is a PCB with copper coated on its both surfaces.

4. An embedded antenna for a mobile terminal according to claim 3, wherein said antenna unit has three conductive strips printed on a first surface, respectively connected to one of said ground pin, feed pin and an end of parasitic unit;

said antenna unit has on a second surface: a feeding point (202), connected to a conductive strip of the feed pin, via a metalized hole penetrating both surfaces of the antenna unit; a grounding point (201), connected to a conductive strip of the ground pin, via a metalized hole penetrating both surfaces of the antenna unit.

5. An embedded antenna for a mobile terminal according to claim 4, wherein the second surface of said antenna unit is etched to form two parallel electromagnetic resonator with the feeding point as a join point.

6. An embedded antenna for a mobile terminal according to claim 5, wherein conductive strip lengths of said two electromagnetic resonators formed on the second surface of said antenna are respectively La and Lb, and La and Lb meet:

$$La = \frac{\lambda_1}{4\sqrt{\varepsilon_{re1}}} \quad Lb = \frac{\lambda_2}{4\sqrt{\varepsilon_{re2}}}$$

where $\lambda_1$, $\epsilon_{re1}$ are respectively a first working wave length and the effective dielectric capacity of the dielectric below the conductive strip of length La; $\lambda_2$, $\epsilon_{re2}$ are respectively a second working wave length and the effective dielectric capacity of the dielectric below the conductive strip of length Lb.

7. An embedded antenna for a mobile terminal according to claim 6, wherein said first working wave length is that of GSM900 frequency band, and said second working wave length is that of DCS1800 frequency band.

8. An embedded antenna for a mobile terminal according to claim 7, wherein said antenna unit is substantially rectangular, having a first long edge connected to the conductor unit, a second long edge opposite to the first one, which is apart from the conductor unit, and a first and a second short edge opposite to each other;

said antenna unit has a C-shaped etched region in middle of the second surface, where an opening of the C shape is directed to the second short edge, the etched region begins from the middle of the second long edge of said antenna unit, extends towards the first long edge and then towards the first short edge, extends once again towards the first long edge and then towards the second short edge, and finally protrudes towards the second long edge at its rear end.

9. An embedded antenna for a mobile terminal according to claim 8, wherein a distance between the feeding point and the first short edge of the antenna unit L7 is 3.8 mm;

a distance between the grounding point and the first short edge of the antenna unit L8 is 1.5 mm;

a distance between the conductive strip connected to the parasitic unit and the second short edge of the antenna unit L11 is 2.0 mm;

a distance between the feeding point and the first long edge of the antenna unit w1 is 2.1 mm;

a distance between the grounding point and the first long edge of the antenna unit w2 is 5.9 mm.

10. An embedded antenna for a mobile terminal according to claim 9, wherein the etched pattern on the second surface of the antenna unit is so formed such that on the second long edge of the antenna unit, the distance between the edge of the opening of the etched region close to the first short edge of the antenna unit and the first short edge of the antenna unit L1 is 20.0 mm;

a distance between the edge of the opening of said etched region close to the second short edge of the antenna unit and the second short edge of the antenna unit L2 is 14.0 mm;

a distance between the edge of said etched region closest to the first short edge of the antenna unit and the first short edge of the antenna unit L3 is 5.5 mm;

a distance between the edge of said etched region most recessed towards the first short edge of the antenna unit and the first short edge of the antenna unit L4 is 6.5 mm;

on the second long edge of the antenna unit, a distance between the edge of the opening of the etched region close to the second short edge of the antenna unit and the second short edge of the antenna unit L5 is 21.0 mm;

a distance between the root of the protuberance at the rear end of the etched region and the first short edge of the antenna unit L6 is 22.2 mm;

the distance between the edge of said etched region closest to the second short edge of the antenna unit and the second short edge of the antenna unit L9 is 6.5 mm;

a distance between the top of the protuberance at the rear end of the etched region and the first long edge of the antenna unit w5 is 5.0 mm;

a distance between the outer edge of the etched region most apart from the first long edge of the antenna unit and the first long edge of the antenna unit w6 is 5.0 mm;

the distance between the inner edge of the etched region most apart from the first long edge of the antenna unit and the first long edge of the antenna unit w7 is 4.7 mm;

a distance between the inner edge of the etched region closest to the first long edge of the antenna unit and the first long edge of the antenna unit w8 is 2.6 mm;

a distance between the outer edge of the etched region closest to the first long edge of the antenna unit and the first long edge of the antenna unit w9 is 2.2 mm.

11. An embedded antenna for a mobile terminal according to claim 4, wherein said parasitic unit is a metal sheet.

12. An embedded antenna for a mobile terminal according to claim 11, wherein said parasitic unit is connected with said antenna unit on the first surface of the antenna unit, and extends in parallel to and apart from the second surface of the antenna unit after two right-angle bends.

13. An embedded antenna for a mobile terminal according to claim 12, wherein a distance between the end edge of the parasitic unit extending along the second surface of the antenna unit and the second short edge of the antenna unit L10 is 14.5 mm;

a distance between the edge of the parasitic unit in parallel to and apart from the antenna unit and the first surface of the antenna unit wj is 3.0 mm

14. An embedded antenna for a mobile terminal according to claim 13, wherein a distance between the edge on the side of the parasitic unit towards the conductor unit and the first long edge of the antenna unit w3 is 0 mm;

a distance between the edge on the side of the parasitic unit apart from the conductor unit and the first long edge of the antenna unit w4 is 6.0 mm.

15. A mobile terminal comprising an embedded antenna according to any one of the preceding claims, wherein the mobile terminal includes a grounding board used as the conductor unit (101).

* * * * *